United States Patent [19]

Smith

[11] Patent Number: 5,018,450

[45] Date of Patent: May 28, 1991

[54] LUMINESCENT PAINTBALL FOR MARKING NIGHTTIME IMPACTS

[76] Inventor: Henry J. Smith, RR3 P.O. Box 234, Elverson, Pa. 19520

[21] Appl. No.: 514,302

[22] Filed: Apr. 25, 1990

[51] Int. Cl.[5] ..... F42B 12/40

[52] U.S. Cl. ..... 102/513; 102/498; 102/502; 273/58 H; 273/DIG. 24; 362/34

[58] Field of Search ..... 102/502, 513, 498, 429; 362/34; 273/418, DIG. 24, 58 B, 58 BA, 58 H

[56] References Cited

U.S. PATENT DOCUMENTS

| | | | |
|---|---|---|---|
| 3,429,263 | 2/1969 | Snyder et al. | 102/513 |
| 3,492,945 | 3/1970 | Filippe | 102/498 |
| 3,539,794 | 11/1970 | Rauhut et al. | 362/34 |
| 3,764,796 | 10/1973 | Gilliam et al. | 362/34 |
| 3,774,022 | 11/1973 | Dubrow et al. | 102/513 |
| 3,940,605 | 2/1976 | Gerber | 102/513 |
| 4,706,568 | 11/1987 | Lundwall et al. | 102/513 |

*Primary Examiner*—Harold J. Tudor

[57] ABSTRACT

For use in marking nighttime impacts from easily ruptured paintball type projectiles that are fired from compressed air guns; this invention provides a double chamber projectile capsule that contains two chemical agents which, when mixed together on impact, provide a luminescent spot to visibly mark impacts at night; for police and military training, as well as the popular adult war games, based on the present paint ball and air gun equipment.

The unique modifications are designed to fit into the present standardized paintball specifications, without adding unusual expense. A double barrier feature assures necessary shelf life and complete separation of the reactive agents; as well as increased ease of loading the two chemical agents during manufacture.

2 Claims, 5 Drawing Sheets

LUMINESCENT PAINTBALL FOR MARKING NIGHTTIME IMPACTS

This invention is in the field of "paintball" projectiles, which are fired from air driven guns, to leave a mark where they have made an impact. In particular, the new dual compartment paintball will provide the means to carry out nighttime war games by leaving a visible luminescent spot when two separate chemical agents, that are contained in two separate compartments within the standard sized capsule, mix together when the capsule and compartments are ruptured on impact.

BACKGROUND OF INVENTION

The first paintball projectiles were designed for marking trees when fired from special air guns. During the last ten years, however, the use of paintballs in adult war games, as well as police and military training, has grown into a major industry.

The "games" have generally been played during the daytime hours, to enable the participants to see when an adversary has been "hit". The games are often played in wooded areas where there are natural hiding and stalking places for the participants; but there are now more and more games being set up in relatively small areas, where there are many artificial objects set up to create more possible action in a relatively small space.

Many of the participants feel that there is more anxiety created, and therefore more thrills, in a dimly lit nighttime atmosphere. In addition, nighttime games, with their limited visibility, could be played in smaller, less expensive areas. One basic problem in nighttime games is that the "hits" from the paintballs can not be easily seen.

It is, therefore, one object of this invention to provide a luminescent paintball that would be a direct replacement for the standard types; and would enable the games or training exercises to be carried out under very dimly lit, or even dark conditions.

There are several stringent requirements that must be met by standard paintballs, to make them practical when used against human participants. The capsule projectiles are made of relatively thin plastic or gelatin type material that crushes very easily on impact; to allow quick "splattering" of the contained water washable paint; while causing a minimum impact sting to the targeted participant.

It is also important to keep the size and concentricity of the paintballs as accurate as possible, since the air guns, including rapid fire "automatic" types, are getting more and more sophisticated.

Therefore, it is another object of this invention to provide a method of fabrication and loading of the chemical agents that will also contribute to the accuracy and uniformity of the finished paintball projectiles.

As with most reactive two part chemicals, such as two part epoxy, etc., the two chemical agents that will cause luminescence are not especially sensitive to the exact mixing ratio. A very small amount of one of the chemical agents, if accidentally mixed with the other, can cause long term degredation of the whole desired reaction, when fully mixed.

It is, therefore, still another object of this invention to provide a two compartment paintball, that by the nature of its construction and assembly procedure, can completely avoid the possibility of the separated chemical agents from leaking or mixing. The structural design completely eliminates dependence on any sealed interface, that would have to be perfect to avoid long term or shelf life problems from even micro leakage. In addition, expensive in-process inspection will not be required with the construction of the invention.

When comtemplating the construction of a standard single compartment paintball, which is completely filled with a washable paint, it is obvious that a special filling process must be used to completely fill the capsule while the two hemispheres of the capsule are being joined together; or after they are joined together.

It is, therefore, still another object of this invention, by the completion of two separate sealed hemispheres before the final joining, to greatly simplify the filling and sealing process.

In all paintball designs it is very important to maintain an easily crushable shell. In the case of a divided two compartment capsule, such as required for the luminescent paintball invention, the dividing membranes must be even more easily broken than the outside shell, to assure the proper instant mixing during the process of crushing on impact.

It is yet another object of this invention to provide the means to make the separating membranes of especially thin material, while providing a relatively rigid structure that can impart a high degree of accuracy to the matching hemisphere cross sections, during the loading and sealing of the individual hemispheres.

The simplicity of the design, which provides all of the above mentioned objectives in an easily implemented manufacturing process, will be more clearly revealed in the following drawings, operational description, and appended claims.

Please note: In all of the drawings the thickness of the capsule walls has been exaggerated for clarity. The actual size of a typical paintball is between ⅝ inch and ¾ inch diameter; and the typical wall thickness only around 0.010 inch. The capping membranes for the individual hemispheres must be thinner (i.e. only 0.002 to 0.004 inch), since they must be first to break up during an impact.

CONSTRUCTION AND OPERATION FEATURES

Figure 1A:
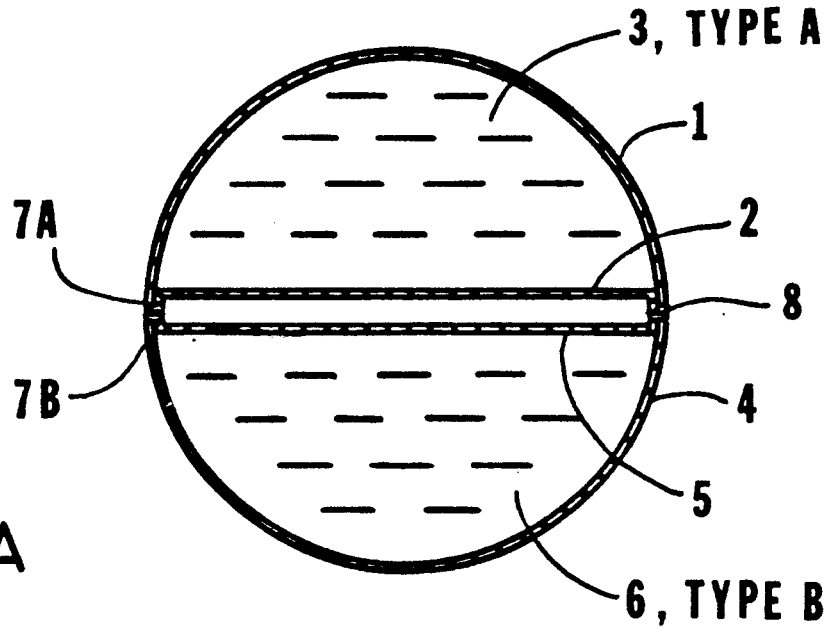
FIG. 1A shows a cross section of a totally assembled round capsule, and the parts associated with the two separate chambers for containing the two separate chemical agents.
Figure 1B:
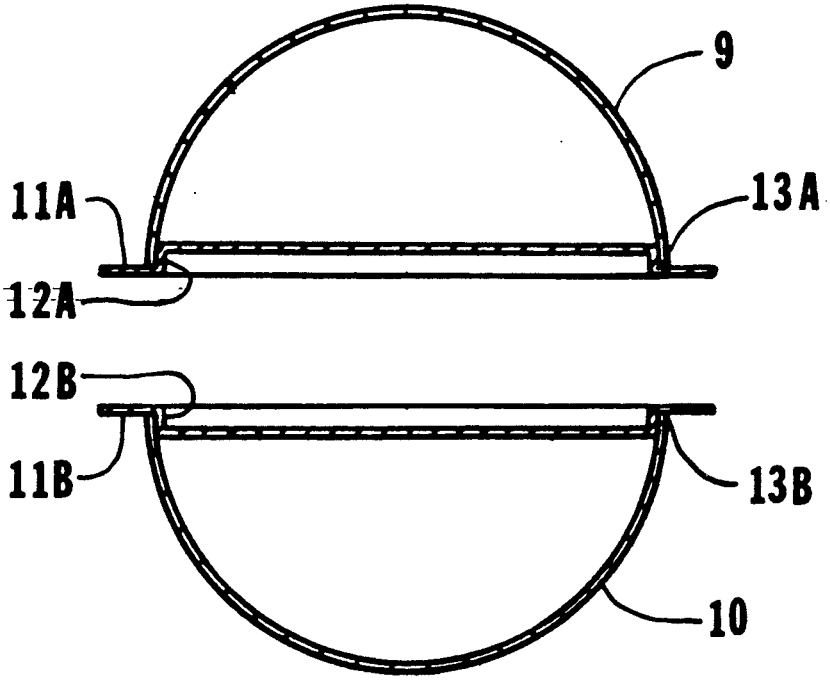
FIG. 1B shows the two separate individually sealed hemispheres before they are fused together and accurately trimmed at their joining circumference.

With reference to FIG. 1A, a cross section of a completed two compartment capsule is shown, made up of a top hemisphere shell 1, and a fused capping membrane 2, which contains a type A chemical agent 3.

Similarly, the lower hemisphere is made up of a shell 4 and a fused capping membrane 5, which contains a type B chemical agent 6.

Figure 8:
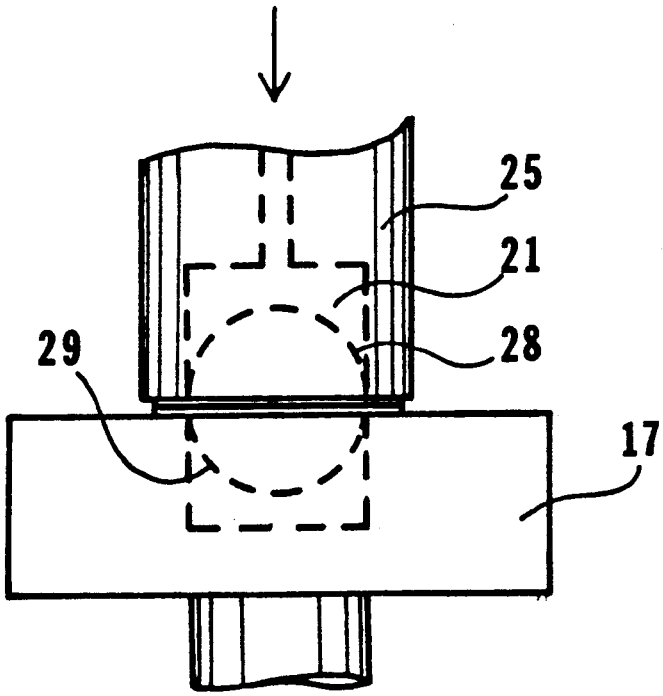
FIG. 8 shows the fusing of the upper and lower hemispheres in perfect allignment.

Each of the individual cap membranes 2 and 5 have a raised fusion rim 7A, 7B, which are formed to a perfect circle and provide an extended fusion area for the thin shells 1, and 4; which are about 0.010 inch in thickness, and the even thinner capping membrane, which are about 0.002 to 0.004 inch thick. A small extension lip 8 around each of the capping membranes 2,5 adds rigidity during assembly, and extends the fusion area 8 between the two hemisphere edges; which also facilitates the fusion of the two hemispheres, prior to the final trimming operation, as shown in FIG. 8.

The extended rim 11A,B and raised step 12A,B on the very thin capping membrane 2,5 serve several purposes. First, they convert the very flimsy membrane material into an accurate and more rigid piece.

Second, the raised portion of the rim 12A,B, is a perfect circle which, when pressed into the I.D. of the hemisphere, causes the hemisphere to also assume a perfectly round cross section. In addition, the raised step 12A,B of the extended rim 11A,B, adds a fusion band 24 around the inside lip of the hemisphere, and the trimmed edges 13A,B.

Third, the capping membrane rims 11A,B, besides adding rigidity, add extended area for holding fusing fluid during the final fusing process, and greatly facilitate the final trimming operation (see FIG. 9), when the extension rims 11A,B, are shaved off as a single fused ring.

THE METHOD OF ASSEMBLY

Step 1

Figure 3:
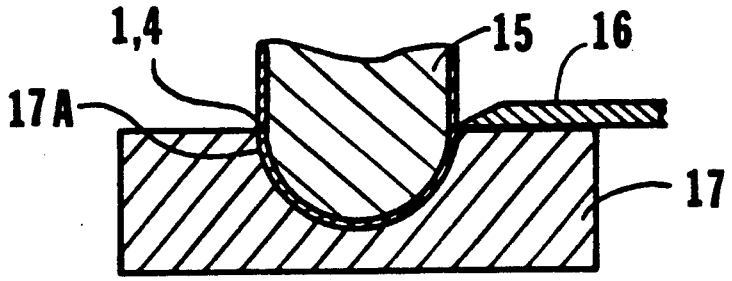
FIG. 3 shows the first step in holding and trimming a hemisphere shell, for either Type A or Type B hemispheres.

With reference to FIG. 3, the assembly sequence begins with placing a capsule shell 1,4 in a holding block 17, which has a circular receiving chamber 17A which fits the O.D. of the hemisphere shell 1,4. A vertical shell holder 15 is used to hold the unfinished hemisphere shell firmly in place in the holding block 17 while a rotating cut off knife 16 cuts off the top edge of the hemisphere shell 1,4 against the vertical shell holder 15.

Step 2

Figure 4:
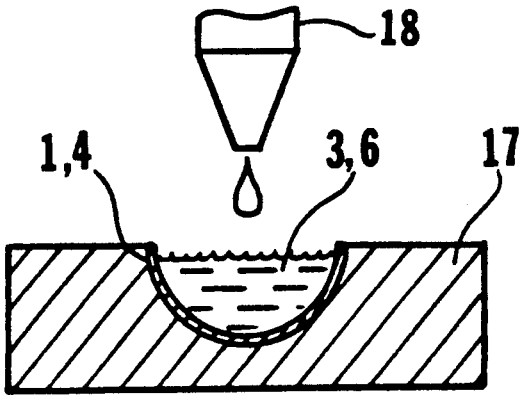
FIG. 4 shows the easy filling of a single horizontal hemisphere.

FIG. 4 shows the hemisphere shell 1,4 being filled with the chemical agent 3,6, which is measured from the source nozzle 18, up to a level that is just below the top edge 13A,B of the hemisphere shell 1,4.

Step 3

Figure 5:
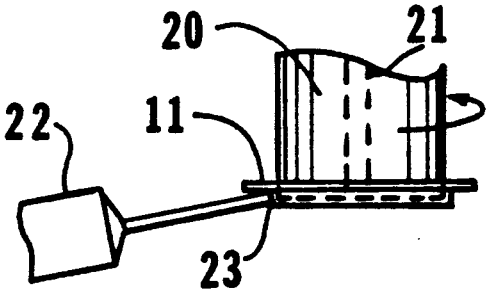
FIG. 5 shows the grasping of the thin "hat shaped" capping membrane with a round rotating vacuum holder, while fusing liquid is applied around the contacting rim area.

FIG. 5 shows the capping membrane 2,5 being held by a vacuum holder 20 with vacuum vent 21. The vacuum holder 20 is made to rotate while a wetting fluid source 22 distributes fluid on the rim area 23 of the capping membrane 2,5.

Step 4

Figure 6:
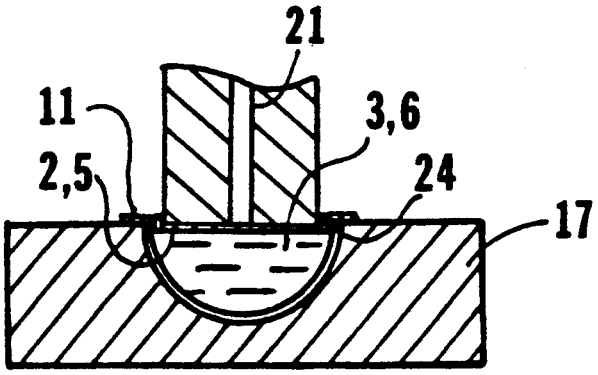
FIG. 6 shows the insertion of the wetted cap into the filled hemisphere, with a short spin to aid the fusing.

FIG. 6 shows the capping membrane 2,5 being inserted in the hemisphere shell 1 where fusion will take place in the sealing area 24, which is all around and over the top edge of the shell 1,4. A small amount of rotation of the vacuum holder 20 helps the sealing process.

Step 5

Figure 7:
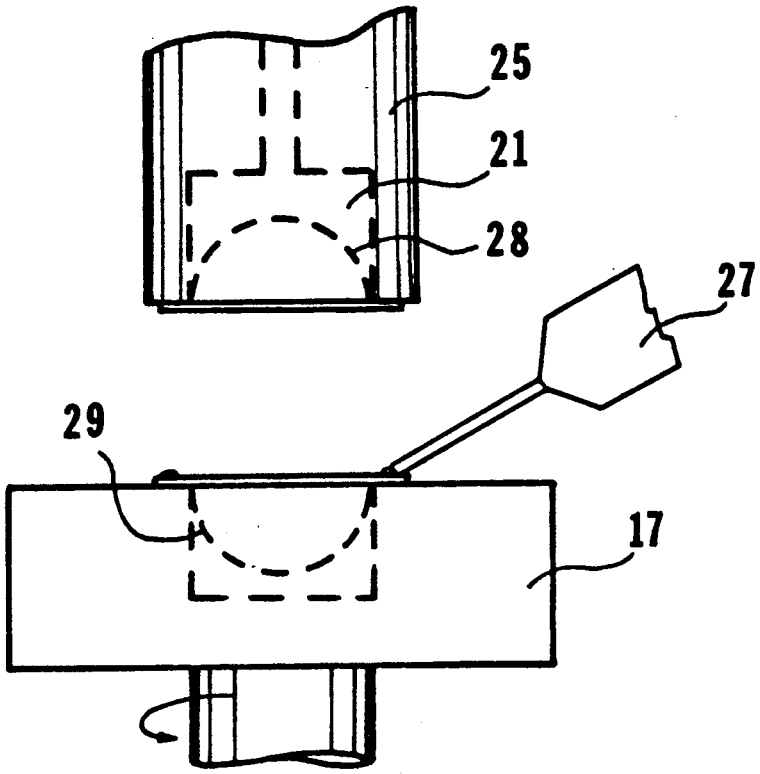
FIG. 7 shows the preparation of the opposing completed hemispheres with sealing fluid prior to fusing them together.

With reference to FIG. 7 another holder 25 with a vacuum chamber 21 that is the O.D. of a finished hemisphere, holds the Type A filled and sealed Hemisphere 28. Fusing of the type A hemisphere 28 with the type B hemisphere 29 takes place when the vacuum holder 25 is moved downward and presses the two hemisphere rims 11A and 11B together, while they are in perfect allignment; as shown in FIG. 8.

Step 6

Figure 9:
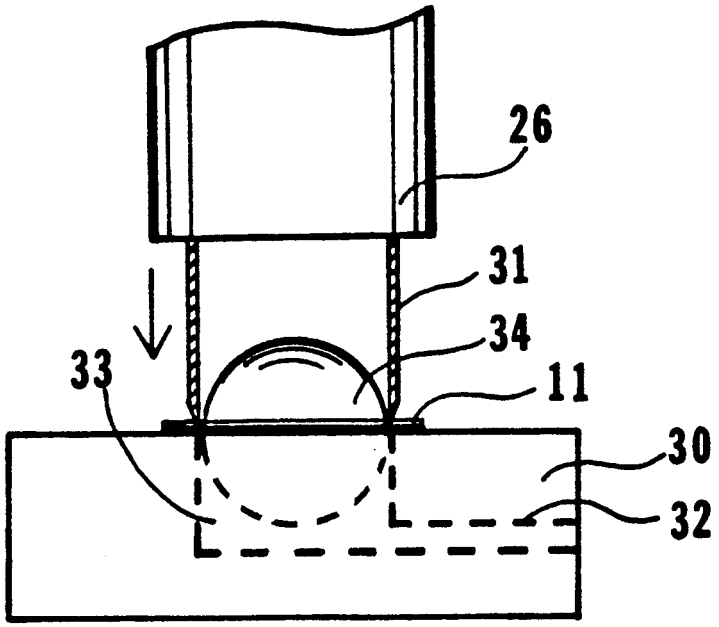
FIG. 9 shows the flush trimming of the complete two compartment sphere with a "steel rule" type cutting die.

As shown in FIG. 9; after the hemisphere rims 11A and 11B are quickly sealed, the complete fused and filled ball is held by the vacuum base 30 and, after moving a circular "steel rule" knife die 31 into place, which has an I.D. that is the exact O.D. of the fused ball, the holder 26 and circular blade 31 is lowered to closely shave off the extended rims 11A,B of the fused capping membranes 2,5, to a close tolerance of the ball outside diameter.

Step 7

Figure 10:
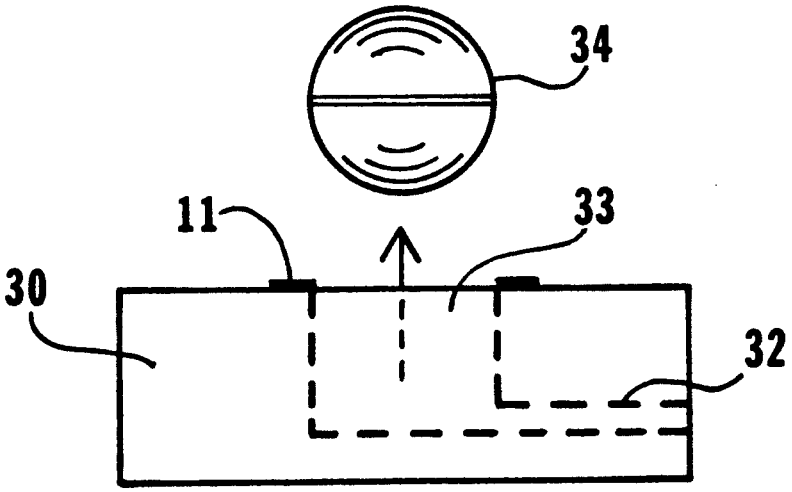
FIG. 10 shows the completed two compartment paintball being ejected from the vacuum holder by momentary air pressure.

FIG. 10 shows the completed dual chamber ball 34 being ejected by pressure applied thru the vent 32 to the chamber 33 of the holding base 30.

HOW THE DUAL CHAMBER CAPSULE COLLAPSES ON IMPACT

With reference to FIGS. 2A thru 2D, a sequence of drawings shows a representation of the collapsing of a capsule, during a succession of moments after an impact.

Figure 2A:
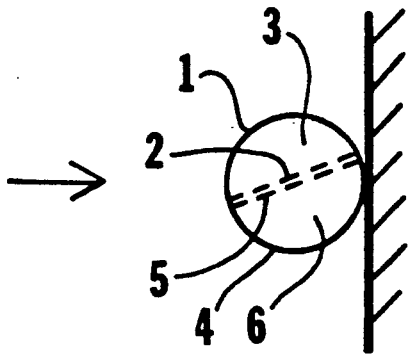
FIGS. 2A thru 2D show the stages of a capsule crushing and mixing the contents of both compartments on impact.

FIG. 2A shows the capsule at the first moment of impact.

Figure 2B:
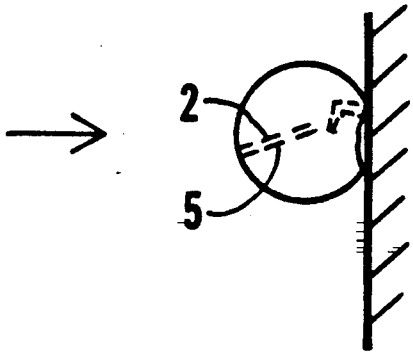

FIG. 2B shows the capsule just beginning to deform, and the first rupturing of the internal capping membranes 2,5.

Figure 2C:
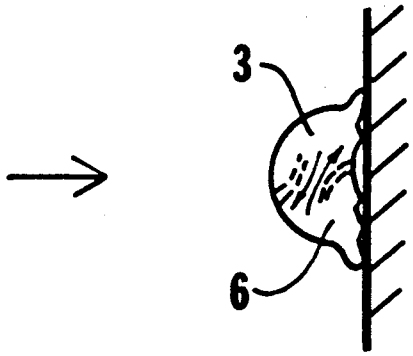

FIG. 2C shows a more advanced stage of the collapse, with total rupturing of capping membranes 2,5; and the main capsule shells 1,4 just beginning to rupture.

Figure 2D:
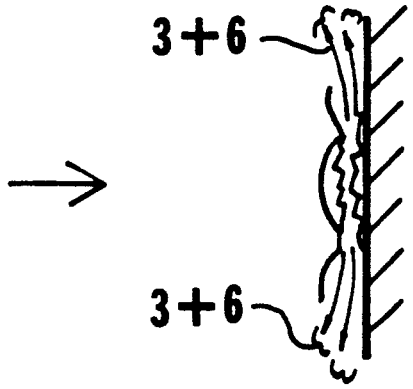

FIG. 2D shows the moment when there is a complete collapse of the capsule, and the wide spread dispersion and mixing of the two chemical agents 3 and 6, from both of the original compartments in the capsule.

THE LUMINESCENT CHEMICAL AGENTS

The two chemical agents which can be used in this invention are typically made up of an oxalic-type ester in one compartment, and a hydroperoxide with a solvent and flourescent compound in the other. Any two part combination of flourescing agents may be used, so long as they are efficient in producing light; and have the property of maintaining the illumination over an extended period of around six hours.

These chemical agents are not injurious to persons, who always wear eye covers at all times. Also they are bio degradable, and safe for the environment.

I claim:

1. A spherical and easily crushable projectile with two separate chambers which contain two separate reactive chemicals that become a chemiluminescent light source when mixed on impact; comprising:

two separate individually sealed hemispheres which are fused together to form an accurate sphere which has two fused capping membranes to isolate said two separate reactive chemicals;

said two fused capping membranes each having a raised fusion rim which forms said separate individually sealed hemispheres into a perfectly round cross section and increases the fusion area of said fused capping membranes; and said raised fusion rim including a small extended lip which contacts an increases the fusion rim to trimmed edges of said separate individually sealed hemispheres and extends all possible leakage points of said raised fusion rims to the outside of said spherical and easily crushable projectile.

2. The elements of claim 1, wherein said two separate reactive chemicals contain colored pigment for either daytime or nighttime use.

* * * * *